United States Patent [19]

Hunsaker

[11] Patent Number: 4,829,494

[45] Date of Patent: May 9, 1989

[54] ACOUSTIC PINGER FOR USE IN HIGH SPEED WATER ENTRY TEST BODIES

[75] Inventor: Glen L. Hunsaker, San Diego, Calif.

[73] Assignee: The United States of America as represented by the Secretary of the Navy, Washington, D.C.

[21] Appl. No.: 161,510

[22] Filed: Feb. 29, 1988

[51] Int. Cl.[4] ..... H04R 1/02

[52] U.S. Cl. ..... 367/173; 367/2; 367/152; 367/165; 73/170 A

[58] Field of Search ..... 310/337; 367/173, 165, 367/157, 152, 141, 910, 191, 2, 3, 4, 162, 141, 106; 73/170 A, DIG. 4; 114/21.3

[56] References Cited

U.S. PATENT DOCUMENTS

| | | | |
|---|---|---|---|
| 3,846,744 | 11/1974 | Renna et al. . | |
| 4,007,633 | 2/1977 | Thompson | 73/170 A |
| 4,449,211 | 5/1984 | Schmidt et al. | 367/153 |
| 4,463,454 | 7/1984 | Hemond et al. . | |
| 4,523,122 | 6/1985 | Tone et al. . | |
| 4,545,041 | 10/1985 | Tim et al. . | |
| 4,731,763 | 3/1988 | Wagner . | |

OTHER PUBLICATIONS

*Exploring Subsurface Waves with Neutrally Buoyant Floats,* by Pochapsky, Hudson Laboratories.

*Primary Examiner*—Deborah L. Kyle
*Assistant Examiner*—J. Woodrow Eldred
*Attorney, Agent, or Firm*—Harvey Fendelman; Thomas G. Keough

[57] ABSTRACT

Tracking and location of a high speed water rentry vehicle is assured by the inclusion of an acoustic source. An acoustic generator in the form of a piezoelectric transducer is potted in polyurethane and fills a volume aft of a disc-shaped wall in the re-entry vehicle. The potting compound couples the acoustic generator to the metal skin to enable acoustic transmission from the vehicle to the tracking range. Optionally, a layer of material is interposed between the potting compound and the vehicle's metal skin to aid in acoustically coupling the generator's output to the metal skin. No structural modifications of the entry vehicle are required yet the pinger is capable of sustaining re-entry shock.

3 Claims, 2 Drawing Sheets

ACOUSTIC PINGER FOR USE IN HIGH SPEED WATER ENTRY TEST BODIES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

An instrument package entering the water at very high rates (1500 to 2000 feet per second), was to be tracked on an acoustic range. An acoustic pinger was required that would survive the impact of water entry and provide tracking pings allowing tracking of the high speed instrument package. The program requires to know the path taken by the instrument package and its velocity after entry. A by-product of the successful tracking would locate the package on the bottom if the range tracks it to the bottom.

Acoustic pingers have been attached to some of the vehicles yet often times they do not survive the entry impact. Methods of mounting some acoustic pingers cause problems in themselves by reason of structural modifications in the entry vehicle.

Thus, there is a continuing need in the state of the art for an acoustic pinger capable of surviving a water entry impact and which requires no performance comprising modifications of the host vehicle.

SUMMARY OF THE INVENTION

The present invention is directed to providing an apparatus for enabling the in-water acoustic tracking of a high speed water entry body having a metal skin. A lateral mounting surface is provided within the body which is an integral component of the body itself and polyurethane potting compound carried adjacent to the lateral mounting surface contains an acoustic generator. The potting compound couples the generator to the entry body's metal skin and, optionally, includes a layer of material to enhance the acoustic coupling of energy from the acoustic generator to the metal skin. Thusly configured, the location marker is capable of sustaining water impact shock and it does not require modifications which might otherwise compromise the entry body's structural integrity.

A prime object of the invention is to provide an acoustic tracking pinger for a high speed water entry body.

Another object is to provide acoustic tracking for a high speed water entry body that is capable of withstanding water entry shock.

Yet another object is to provide an acoustic tracking pinger that does not require structural modifications of the host entry body that might compromise its structural integrity.

Yet another object is to provide for an acoustic tracking pinger on omni-directional acoustic tracking signal.

Yet another object is to provide a bottom locating marker for a high speed water entry body.

These and other objects of the invention will become more readily apparent from the ensuing specification and drawings when taken in conjunction with the appended claims.

DESCRIPTION OF THE PREFERRED EMBODIMENT

Figure 1:
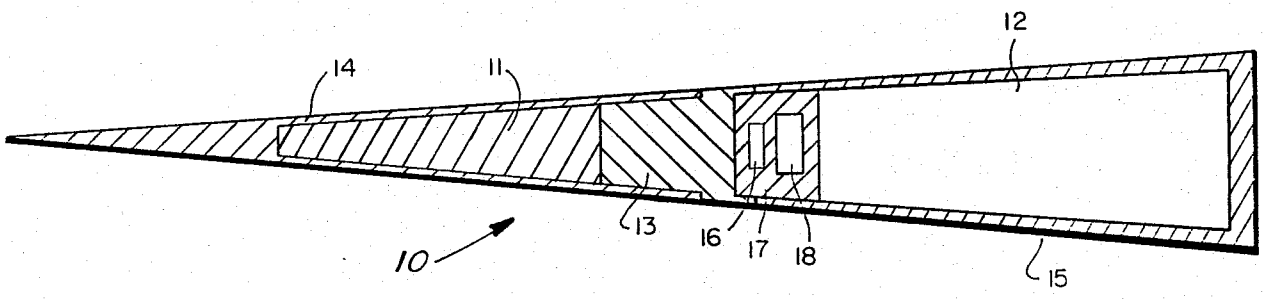
FIG. 1 is a cross-sectional representation of a typical high speed water entry body including the acoustic pinger of this inventive concept.

Referring now to the drawings, the high speed water entry body 10 has a forward compartment 11 containing lead and an aft compartment 12 that contains instrumentation. A laterally extending structural member 13 is included in the entry body as an integral structural member linking a nose cone portion 14 to a metal skin portion 15.

The structural member provides a disc-shaped lateral mounting surface for an acoustic signal generator 16 that is supported and held in place by a polyurethane potting compound 17. The acoustic generator can be any one of number of proven design which generate acoustic signals in response to appropriate electrical driving signals. A 3.14 inch outer diameter ceramic cylinder, piezoelectric, has been chosen to successfully project an appropriate acoustic signal although different configurations and materials could be selected that have the capability for surviving a water entry impact when properly supported in an entry vehicle.

The polyurethane potting compound fills a frustum-conical volume between the lateral mounting surface and the inside of the entry body's metal skin to at least partially acoustically couple the energy from the acoustic generator to the metal skin. The metal skin omnidirectionally radiates the acoustic energy acceptably to assure location of the entry body. An electronics-power pack 18 is carried adjacent the acoustic source and is contained within potting compound 17.

The potting compound at least partially acoustically couples the ceramic cylinder to metal skin 15 of the entry body. Looking to FIG. 2 a modification of this concept calls for the inclusion of an acoustically coupling layer 19 between potting compound 17 and metal skin 15 to become part of a frustum conical form. The acoustic coupling material is selected to have a thickness equal to a quarter wavelength of the transmitted acoustic location marker signal projected from piezoelectric ceramic cylinder 16. The mechanical impedance of the acoustic coupling material is selected to be a geometric mean between the acoustic impedance of the polyurethane, $Z_1$ and the acoustic impedance of the steel outer skin $Z_2$ where $Z_1 = P_1 C_1$ and $Z_2 = P_2 C_2$ ($P_1$ $P_2$ being the densities and $C_1$ $C_2$ being the speed of sound through the respective materials).

Figure 2:
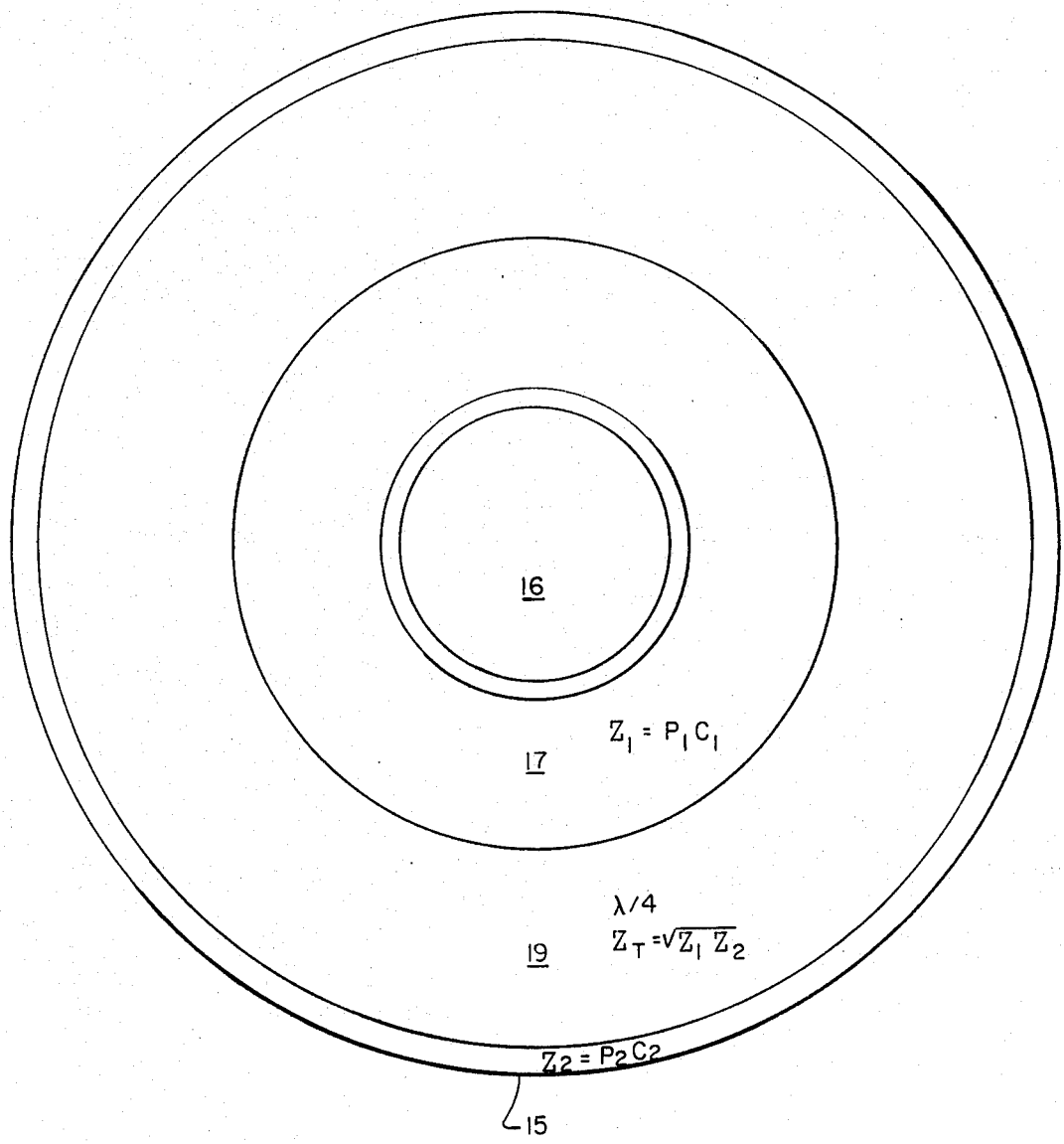
FIG. 2 shows a cross-sectional view of the acoustic pinger including a layer for improving acoustic transmission.

The optional inclusion of the acoustic coupling layer 19 as depicted in FIG. 2 is relied upon when transmission through the metal skin 15 needs to be enhanced. This can be the case when structural "anti-resonances" reduce the acoustic transmission through the metal skin 15. Irrespective if the acoustic coupling layer is selected or not the acoustic pinger does not require any structural modifications to the entry body. From the foregoing it is apparent that the proper acoustic coupling of the acoustic location marker signal from the acoustic projector to the entry body's metal skin results in an omni-directional signal that aids tracking and recovery of the entry body. Reliable operation of the acoustic pinger is strengthened by its being included in the entry body without structural modifications. This improved reliability helps provide for a higher probability of tracking and recovery of the body.

Obviously, many modifications and variations of the present invention are possible in the light of the above teachings. It is therefore to be understood that within the scope of the appended claims the invention may be practiced otherwise than as specifically described:

I claim:

1. An apparatus for enabling the tracking and location in water of a high speed water entry body having a metal skin comprising:

means disposed in the interior of the entry body as an integral structural member in contact with the skin for providing a lateral mounting surface;

means disposed adjacent the lateral mounting surface for generating an omnidirectional acoustic pinger signal;

a potting compound containing the generating means and filling a volume adjacent the lateral mounting surface and the metal skin for at least partially acoustically coupling the generating means to the metal skin;

means interposed between the partially acoustically coupling means and the metal skin for more completely acoustically coupling the generating means to the metal skin to enable the transmission of the acoustic pinger signal through the skin and surrounding water to assure the tracking and location thereof and an electronics package including a power source potted adjacent the generating means.

2. An apparatus according to claim 1 in which the more completely acoustically coupling means is a $\frac{1}{4}$ wavelength material selected from materials to have characteristics of being the geometric mean between the ranges of acoustic impedances of both the polyurethane and steel.

3. An apparatus according to claim 2 in which the entry body is essentially cone-shaped, the lateral mounting surface is essentially disc-shaped, the partially acoustically coupling means and the more completely acoustically coupling means together fill a volume having a frustum-conical configuration in contact with the lateral mounting surface and the metal skin.

* * * * *